US006595233B2

(12) United States Patent
Pulli

(10) Patent No.: US 6,595,233 B2
(45) Date of Patent: Jul. 22, 2003

(54) SAFETY DEVICE FOR A FLUID TRANSMISSION

(75) Inventor: Giuseppe Pulli, Stäfa (CH)

(73) Assignee: Siemens Building Technologies AG (CH)

( * ) Notice: Subject to any disclaimer, the term of this patent is extended or adjusted under 35 U.S.C. 154(b) by 0 days.

(21) Appl. No.: 09/918,294

(22) Filed: Jul. 30, 2001

(65) Prior Publication Data

US 2002/0066482 A1 Jun. 6, 2002

(30) Foreign Application Priority Data

Aug. 16, 2000 (EP) ..... 00117615

(51) Int. Cl.[7] ..... G05D 16/08
(52) U.S. Cl. ..... 137/115.05; 137/115.08
(58) Field of Search ..... 137/115.06, 115.08, 137/115.05

(56) References Cited

U.S. PATENT DOCUMENTS

| | | | | |
|---|---|---|---|---|
| 3,358,705 A | * | 12/1967 | Krechel | 137/115.16 |
| 4,385,640 A | | 5/1983 | Iverson | |
| 6,035,881 A | | 3/2000 | Emmerich et al. | |

FOREIGN PATENT DOCUMENTS

| | | |
|---|---|---|
| DE | 2326737 | 12/1974 |
| EP | 0 518594 | 12/1992 |
| EP | 0 821166 | 1/1998 |
| FR | 2348432 | 11/1977 |
| GB | 1519336 | 7/1978 |

OTHER PUBLICATIONS

"Gas/Luft–Verhaltnisregler SKP 70", Landis & Gyr, No. CC1N7651D, Aug. 1995.

* cited by examiner

*Primary Examiner*—Stephen M. Hepperle
(74) *Attorney, Agent, or Firm*—Greer, Burns & Crain, Ltd.

(57) ABSTRACT

A safety device (1) for a fluid transmission has a diaphragm (4) which is arranged deflectably in a feed passage (8) and which has at least one through opening (2) for the fluid. A return passage (10) for the fluid from the chamber of the consumer (9) is of such a configuration and arrangement that it can be opened and closed by deflection of the diaphragm (4), wherein the diaphragm (4) is of such a configuration that, when the fluid flow in the feed passage (8) falls below a given value, the return passage (10) is opened. The pressure in a pressure chamber (9) of a consumer can be let off by the device (1) when a pump (7) is no longer conveying.

3 Claims, 2 Drawing Sheets

SAFETY DEVICE FOR A FLUID TRANSMISSION

BACKGROUND OF THE INVENTION

1. Field of the Invention

The invention relates to a safety device for a fluid transmission.

Such devices are suitable for limiting the pressure in a fluid transmission, in which respect the device protects parts of the fluid transmission as well as for example an energy converter connected to the fluid transmission or a load. A device of that kind can also be used for monitoring the volume flow in a fluid transmission.

2. Description of the Prior Art

The publication CC1N7651D from Landis & Gyr discloses a fluid transmission for setting a gas valve for a burner. The fluid transmission (in the edition of the publication dated August 1995, page 2) has a safety device including an axially displaceable hollow cylinder. The ends of the hollow cylinder are of such a configuration and are so arranged in the transmission that a respective throttle location for the hydraulic oil movable by a pump is operative on each of both sides. In dependence on the pressure conditions in the fluid the hollow cylinder is displaceable against a spring force, in which case the opening of one of the two throttle locations is variable and a return passage for the fluid can be fed through that throttle location. That safety device involves a high level of expenditure in terms of achieving the necessary close production tolerances and also requires relatively costly sealing elements. The necessary expenditure is very high in particular if the fluid transmission is to be designed for a relatively great temperature range.

SUMMARY OF THE INVENTION

The object of the present invention is to provide an inexpensive safety device which can be used reliably in a relatively wide temperature range.

In accordance with the present invention, there is provided a safety device for a fluid transmission comprising an energy converter and a consumer connected by way of a feed passage to the energy converter, wherein a pressure can be produced by the energy converter in a chamber of the consumer, the safety device comprising:

a diaphragm which is arranged deflectably in the feed passage and which has at least one through opening for the fluid to pass therethrough, and a return passage for the fluid to return from the chamber of the consumer, wherein the return passage is of such a configuration and arrangement that it can be opened and closed by deflection of the diaphragm, and wherein the configuration of the diaphragm is such that when the fluid flow in the feed passage falls below a given value the return passage is opened.

Advantageous aspects of the invention are set forth in the dependent claims.

BRIEF DESCRIPTION OF THE DRAWINGS

Embodiments of the invention are described in greater detail hereinafter with reference to the drawings in which.

DESCRIPTION OF THE PREFERRED EMBODIMENTS

Figure 1:
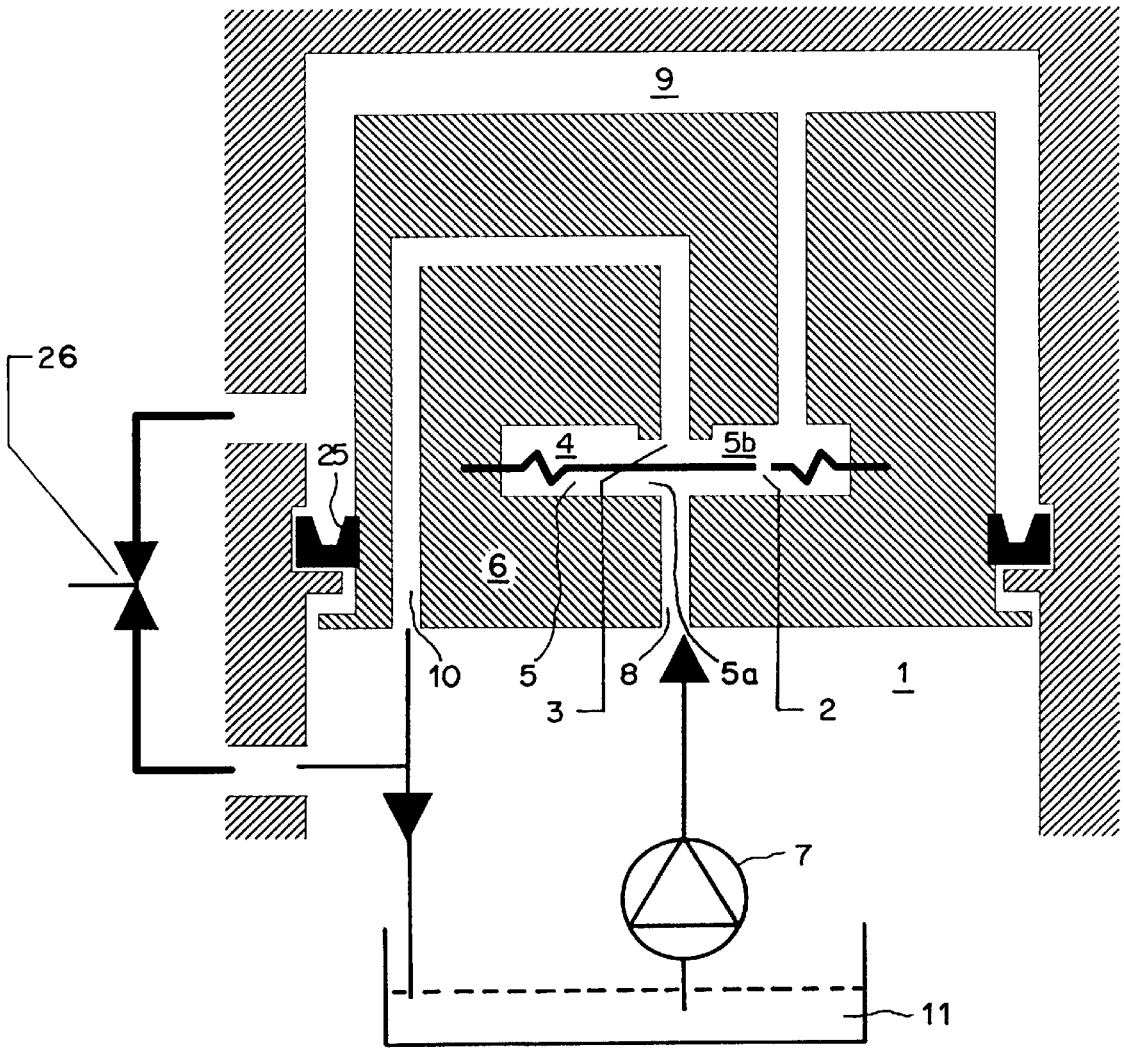
FIG. 1 shows a sectional view of a safety device for a fluid transmission.

In FIG. 1 reference 1 denotes a safety device which has a first throttle location 2, a second throttle location 3 and a diaphragm 4. The diaphragm 4 is advantageously stretched out deflectably within certain limits in a cavity 5 of a main body 6, the cavity 5 being divided by the diaphragm 4 into a first chamber 5*a* and a second chamber 5*b*. The first throttle location is embodied by at least one opening in the diaphragm 4.

An energy converter 7 can be connected by way of a feed passage 8 to a consumer 9, wherein the feed passage 8 is advantageously provided in the main body 6, and is taken from the energy converter 7 into the first chamber 5*a*, further through the first throttle location 2 and finally from the second chamber 5*b* to the consumer 9.

The second chamber 5*b* of the cavity 5 is connected by way of a return passage 10 to a fluid store 11 by which the energy converter 7 is fed at its intake side.

The energy converter 7 is for example a pump driven by an electric motor for conveying the fluid.

In a first operating condition of the safety device 1 the fluid is conveyed through the energy converter 7 by way of the feed passage 8 to the consumer, the fluid flowing through the first throttle location 2. The diaphragm 4 is appropriately deflected in dependence on a pressure difference which obtains between the two chambers 5*a* and 5*b*.

The diaphragm 4 can advantageously be deflected to such an extent that the return passage 10 or the second throttle location 3 respectively can be closed by the diaphragm 4.

In a second operating condition of the safety device 1 in which the volume flow of fluid conveyed by the energy converter 7 falls below a certain minimum value or is zero, the fluid can flow from the consumer 9 by way of the second chamber 5*b* and the return passage 10 into the fluid store 11, in which case the diaphragm 4 is deflected in such a way that the second throttle location 3 is open.

In an advantageous embodiment of the safety device 1 the feed passage 8 is closed by the diaphragm 4 in relation to the energy converter 7 when the energy converter 7 is not conveying. That prevents fluid from flowing back into the energy converter 7 on the outlet side.

In a third operating condition of the safety device 1 the diaphragm 4 is in a position in which both the feed passage 8 and also the return passage 10 are at least partially open, in which case the fluid flows both through the first throttle location 2 and also through the second throttle location 3.

Figure 2:
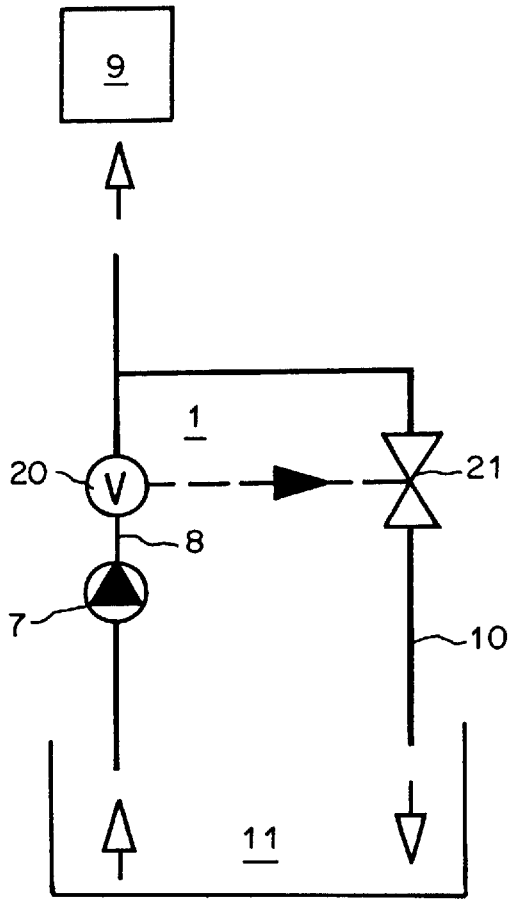
FIG. 2 shows a diagrammatic view relating to the mode of operation of the safety device.

FIG. 2 shows a basic equivalent circuit for the safety device 1 connected to the energy converter 7. A volume flow meter 20 arranged in the feed passage 8 controls a return valve 21 arranged in the return passage 10. The volume flow meter 20 is essentially embodied by the first throttle location 2 in the diaphragm 4 while the diaphragm 4 is operative as the closure body of the return valve 21, in which respect the diaphragm 4 and the return passage 10 are of such an arrangement and configuration that, when the fluid flow in the feed passage 8 falls below a certain value, the return passage 10 is opened, that is to say a zone of the diaphragm 4 by which the return passage 10 can be closed off in sealing relationship for the fluid is moved away by suitable deflection of the diaphragm 4 away from the return passage 10.

Figure 3:
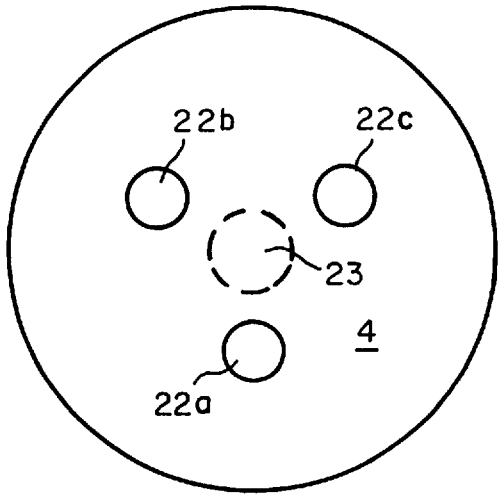
FIG. 3 shows a diaphragm of the safety device, with an opening for a fluid.

An advantageous embodiment of the diaphragm as shown in FIG. 3 has openings 22*a*, 22*b* and 22*c* which are operative as the first throttle location 2. A zone 23 which is advantageously arranged centrally and which is shown in broken line in FIG. 3 acts as the closure body of the return valve 21. By means of the safety device 1 therefore the pressure in a pressure chamber of the consumer 9 can be let off by way of the return valve 21 if a pump or the energy converter 7 is no longer conveying.

It will be appreciated that the design of the diaphragm 4 in respect of shape and material can be adapted within wide limits to the specific demands of the safety device without entailing inventive step and in that respect in particular the temperature fluctuations and pressure conditions to be expected are to be taken into consideration.

In an embodiment of FIG. 1 by way of example the main body 6 is in the form of a movable piston which is displaceable by the pressure which is built up in a pressure chamber of the consumer 9. The pressure chamber is closed off by a sealing ring 25. If necessary the pressure chamber of the consumer 9 is additionally connected by a regulating valve 26 to the fluid store 11. To perform a task the main body 6 can be coupled to an apparatus (not shown). For example the main body 6 is connected by way of a linkage to a closing body of a valve—for example the gas valve of a burner—, whereby the valve is controllable by the main body.

The described safety device 1 for a fluid transmission, with the diaphragm 4 (FIG. 1) which is arranged deflectably in the feed passage 8 and which has at least one through opening 2 for the fluid to pass therethrough can be used reliably in a relatively wide temperature range.

I claim:

1. A safety device for a fluid transmission comprising an energy converter and a consumer connected by way of a feed passage to the energy converter, wherein a pressure can be produced by the energy converter in a chamber of the consumer, the safety device comprising:

a diaphragm which is arranged deflectably in the feed passage and which has at least one through opening for the fluid to pass therethrough, and a return passage for the fluid to return from the chamber of the consumers, wherein the return passage is of such a configuration and arrangement that it can be opened and closed by deflection of the diaphragm, and wherein the configuration of the diaphragm is such that when the fluid flow in the feed passage falls below a given value the return passage is opened, and wherein the diaphragm and the feed passage are of such a configuration and arrangement that the feed passage can be closed off towards the energy converter by the diaphragm if the volume flow of the fluid, which is conveyed by the energy converter, falls below a certain minimum value.

2. A device according claim 1, wherein the diaphragm has a plurality of openings for the fluid.

3. A device according to claim 1, further comprising a valve which is actuable by the fluid transmission.

* * * * *